US005407101A

United States Patent [19]

Hubbard

[11] Patent Number: 5,407,101

[45] Date of Patent: Apr. 18, 1995

[54] THERMAL BARRIER FOR HOT GLUE ADHESIVE DISPENSER

[75] Inventor: Timothy M. Hubbard, Canton, Ga.

[73] Assignee: Nordson Corporation, Westlake, Ohio

[21] Appl. No.: 235,096

[22] Filed: Apr. 29, 1994

[51] Int. Cl.[6] ..... B67D 5/62

[52] U.S. Cl. ..... 222/146.5; 219/421; 222/504; 392/484

[58] Field of Search ..... 222/54, 146.2, 146.5, 222/504; 219/421–427, 494; 392/484; 165/135, 136

[56] References Cited

U.S. PATENT DOCUMENTS

| | | | |
|---|---|---|---|
| 2,995,159 | 8/1961 | Berggren | 219/421 X |
| 3,550,815 | 12/1970 | Salonen | 222/146.5 |
| 3,811,601 | 5/1974 | Reighard et al. | 222/504 |
| 3,818,930 | 6/1974 | Crum et al. | 222/146.5 X |
| 3,827,604 | 8/1974 | Hamilton et al. | 222/62 |
| 4,334,637 | 6/1982 | Baker et al. | 222/600 |
| 4,548,341 | 10/1985 | Hambleton | 222/146.5 X |
| 4,659,016 | 4/1987 | Faulkner, III | 222/550 |
| 4,711,379 | 12/1987 | Price | 222/146.5 X |
| 4,785,996 | 11/1988 | Ziecker et al. | 239/298 |
| 4,969,601 | 11/1990 | Wright | 239/566 |
| 4,969,602 | 11/1990 | Scholl | 239/298 |
| 5,027,976 | 7/1991 | Scholl et al. | 222/146.5 X |
| 5,065,943 | 11/1991 | Boger et al. | 239/298 |

*Primary Examiner*—Kevin P. Shaver
*Attorney, Agent, or Firm*—Roger D. Emerson Co.

[57] ABSTRACT

An apparatus (10) for dispensing hot melt adhesives includes an air gap (100) in the adhesive manifold (16) of the dispenser (10). The apparatus (10) includes a heater (80), a temperature sensing device (RTD) (82) and adhesive passageway (84) located within the adhesive manifold (16) of the dispenser (10). The dispenser (10) delivers heated adhesive to a gun body (12) where it is applied to a substrate. The air gap (100) is interposed between the heater (80) and the adhesive passageway (84) and directs a majority of the heat generated by the heater (80) toward the gun body (12) and toward regions of the apparatus (10) needing additional heating. The air gap (100) enables a desired temperature gradient within the dispenser (100) to be maintained and prevents localized heating or cooling, thus decreasing the possibility that the adhesive will coagulate and plug the dispenser (10).

19 Claims, 3 Drawing Sheets

THERMAL BARRIER FOR HOT GLUE ADHESIVE DISPENSER

DESCRIPTION OF THE INVENTION

This invention relates to adhesive dispensing devices and more particularly to adhesive dispensing devices in which insulating thermal barriers are used to isolate heaters in one region of the device from other regions of the device.

Hot melt thermal plastic adhesives have been widely used in industry for adhering many types of products, and are particularly useful in applications where a quick setting time for the adhesive is needed. One common application for hot melt adhesives is in the cartoning and packaging industry where the quick setting time of hot melt adhesives is helpful when flaps of the cartons must be folded together to form a bond therebetween. Another common application is the bonding of non-woven fibrous materials to a polyurethane substrate in articles such as disposable diapers. Examples of other references directed to hot melt adhesives included U.S. Pat. No. 5,027,976 to Scholl et al., U.S. Pat. No. 5,065,943 to Boger et al., and U.S. Pat. No. 4,969,602 to Scholl.

The plunger utilized in many common adhesive dispensing apparatus to start and stop the flow of adhesive can be actuated by electrical, pneumatic, hydraulic or other commonly known actuating means. In some applications, especially those utilizing electromagnetic forces, portions of the dispensing apparatus may be manufactured of thermally dissimilar metals, e.g., aluminum and stainless steel.

Thermally dissimilar metals can present special challenges in dispensing apparatus for hot melt adhesives. One metal is thermally dissimilar from a second metal if it responds differently to temperature changes. For example, one way thermally dissimilar metals react differently is their respective of thermal expansion. A first metal may expand a certain percentage of its length over a temperature rise while a second may expand a different percentage of its length over the same temperature rise. A second way thermally dissimilar metals can perform differently concerns the way they transfer heat. Thermally dissimilar metals may have different heat coefficients, meaning an equivalent amount of heat added to each of the metals causes a temperature rise in the first metal different than the second metal.

In the case of an adhesive dispensing device for hot melt adhesives, the thermal conductivity of each of the dissimilar metals may form temperature gradients in the apparatus, meaning certain parts of the apparatus are at different temperatures than other parts. If the temperature gradients are near the passageway for the hot adhesive, the gradients can be unsuitable for effective operation of the dispensing apparatus.

Another source of temperature gradients in an adhesive dispensing apparatus is the location within the apparatus of the heaters relative to an adhesive passageway. The heaters are sources of heat which maintain the adhesive within the dispensing device at the proper operating temperature. The adhesive passageway is the portion of the dispensing apparatus which delivers the adhesive to the product to be adhered.

Maintaining the desired temperature along the adhesive path is important in hot melt adhesive applications. If the adhesive is too hot, it will not be dispensed properly in the location, amount and manner intended. If adhesive becomes too cool, it may solidify and coagulate, plugging the adhesive passageway and shutting down the adhesive apparatus.

The present invention contemplates a new and improved hot melt adhesive dispenser which is simple in design, effective in use and overcomes the foregoing difficulties and others while providing better and more advantageous overall results.

SUMMARY OF THE INVENTION

In accordance with the present invention, a new and improved dispenser for dispensing heated fluids such as adhesives is provided.

More particularly, in accordance with the invention, the apparatus includes a adhesive manifold which has an adhesive passageway therethrough. The adhesive manifold has heat redirecting means for insulating a first region of the adhesive manifold from a second region of the adhesive manifold. Heating means are located within the adhesive manifold as well as temperature sensing means for sensing a temperature of the adhesive manifold.

In accordance with another aspect of the invention, the redirecting means is an air gap. The air gap is an "L-shaped" slot within the adhesive dispensing apparatus. The temperature sensing means is a resistance temperature device hereinafter "RTD."

Accordingly, this invention is especially suitable for use with a gun body and a adhesive manifold made from dissimilar materials. For example, in one embodiment, the gun body is made of stainless steel and the adhesive manifold is made of aluminum.

According to a still further aspect of the invention, the heat redirecting means is interposed between the heating means and the temperature sensing means.

According to a further aspect of the invention, a method for directing heat in an apparatus for dispensing heated materials includes the steps of energizing a heating means to heat the apparatus, insulating a first region of the apparatus from a second region of the apparatus by the redirecting means, thereby heating the first region of the apparatus with a heating means to a first desired temperature and heating the second region of the apparatus to a second desired temperature, and controlling the first and second desired temperatures by controlling energy input to the heating means.

One advantage of the present invention is the provision of an apparatus for dispensing hot melt adhesives which can more consistently and accurately heat the adhesive.

Another advantage of the invention is the provision of a heat redirecting means to insulate one region of the dispensing apparatus from another region of the dispensing apparatus.

Still another advantage of the invention is the provision of a redirecting means to provide a barrier for the transmission of heat, thus directing more of the generated heat toward a dispensing module or gun body rather than toward an adhesive passageway within the adhesive manifold regions of the apparatus where the heat is not needed.

Still another advantage of the invention is the ability to use the redirecting means to direct the heat generated by heaters to compensate for thermally dissimilar thermal conductivity in various components of the dispensing apparatus. The use of thermally dissimilar materials in an adhesive dispensing device may offer various advantages depending on the application, as long as the thermally dissimilar properties of materials are manageable. For example, some portions of the device can use high strength materials which might be expensive while other portions of the device may be manufactured with lower cost materials, such as aluminum, where their strength properties are adequate. These advantages would not be possible except for the use of a thermal insulating barrier according to the invention which can direct heat generated to the regions where such heat is needed.

Still other benefits and advantages of the invention will become apparent to those skilled in the art upon a reading and understanding of the following detailed specification.

DESCRIPTION OF THE DRAWINGS

The following is a brief description of the drawings in which like parts may bear like reference numerals and in which.

DETAILED DESCRIPTION OF THE INVENTION

Figure 1:
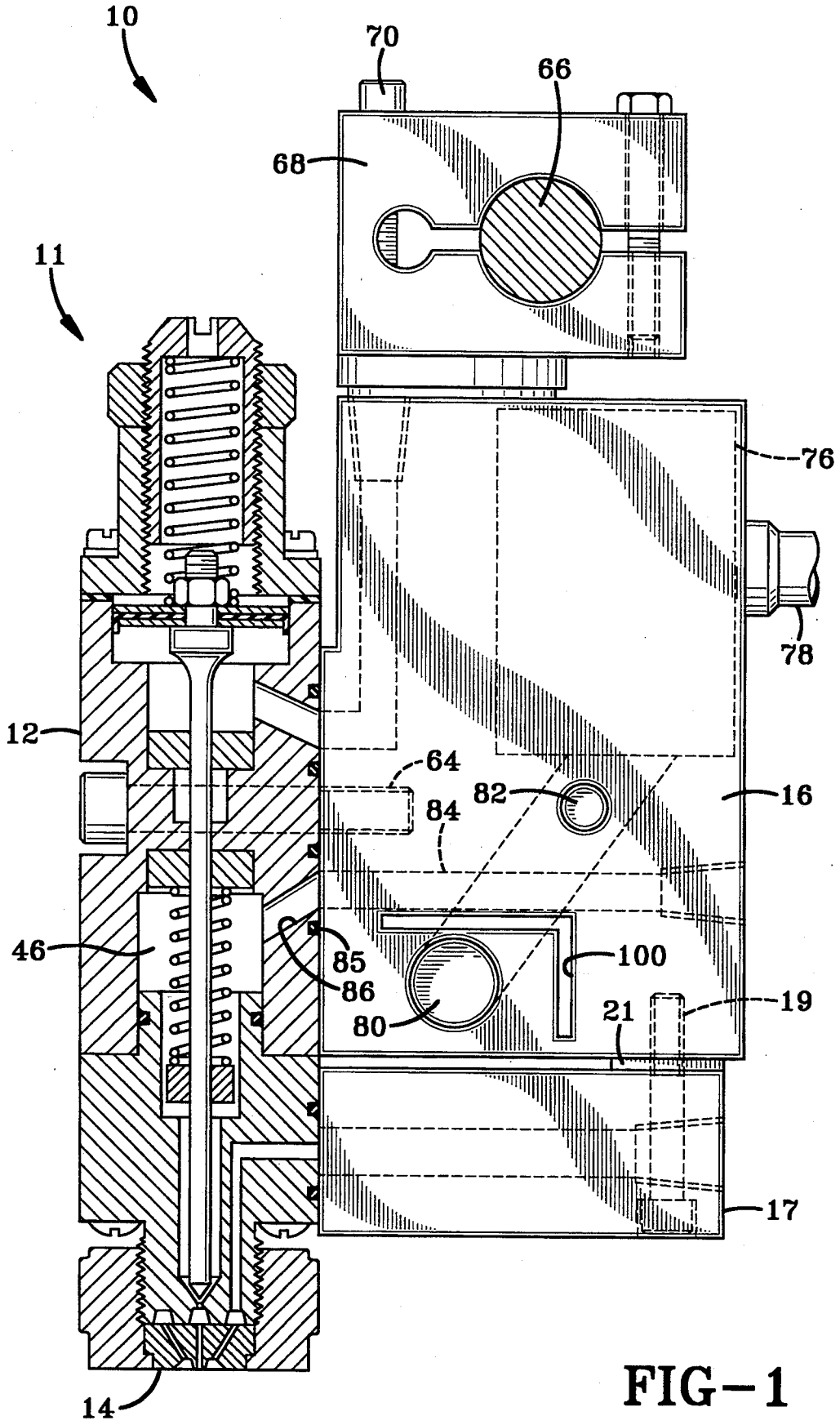
FIG. 1 is a cross-sectional view of a pneumatically actuated dispenser for dispensing heated fluids such as hot melt adhesives incorporating a thermal insulating air gap interposed between the heater and the RTD.

Referring now to the drawings wherein the showings are for purposes of illustrating a preferred embodiment of the invention only and not for purposes of limiting the same, FIG. 1 shows an adhesive dispensing device 10 which includes a dispensing module 11 having a gun body 12. The gun body 12 has a nozzle 14, an adhesive manifold 16 mounted to the gun body 12 and an air manifold 17 mounted to the gun body 12.

The gun body 12 is mounted to the adhesive manifold 16 by mounting bolts 64. The adhesive manifold 16 may be supported on a bar 66 by mounting blocks 68 connected to the adhesive manifold 16 with screws 70. The air manifold 17 is mounted to the adhesive manifold 16 by two or more screws 19, each of which extend through a spacer 21 extending between the adhesive and air manifolds 16,17. The nozzle 14 dispenses a bead of heated hot melt adhesive onto a substrate (not shown), such as a carton or box. The structure of the gun body 12 and manifolds 16,17 are substantially identical to the Model H200 gun manufactured and sold by the assignee of this invention, Nordson Corporation of Amherst, Ohio. This configuration of an adhesive dispensing device is known in the art and is discussed in detail in U.S. Pat. No. 4,785,996 to Ziecker et al. and U.S. Pat. No. 4,969,602 to Scholl, the disclosures of which are incorporated herein by reference in their entirety.

The adhesive manifold 16 is formed with a junction box 76 which receives an electric cable 78 to supply power to a heater 80 and a resistance temperature device (hereinafter "RTD") 82. The RTD 82 senses the temperature of the manifold 16 near the RTD and provides feedback control to the heater 80. The heater 80 generates heat and maintains the hot melt adhesive in a molten state when it is introduced into the adhesive manifold 16 through an adhesive inlet line 84 from an external source of hot melt adhesive (not shown). The adhesive inlet line 84 communicates through a fluid passageway 86 formed in the gun body 12 with the adhesive cavity 46. An O-ring 85 is provided between the gun body 12 and adhesive manifold 16 at the junction of the adhesive inlet line 84 and fluid passageway 86 to form a seal therebetween.

Figure 2:
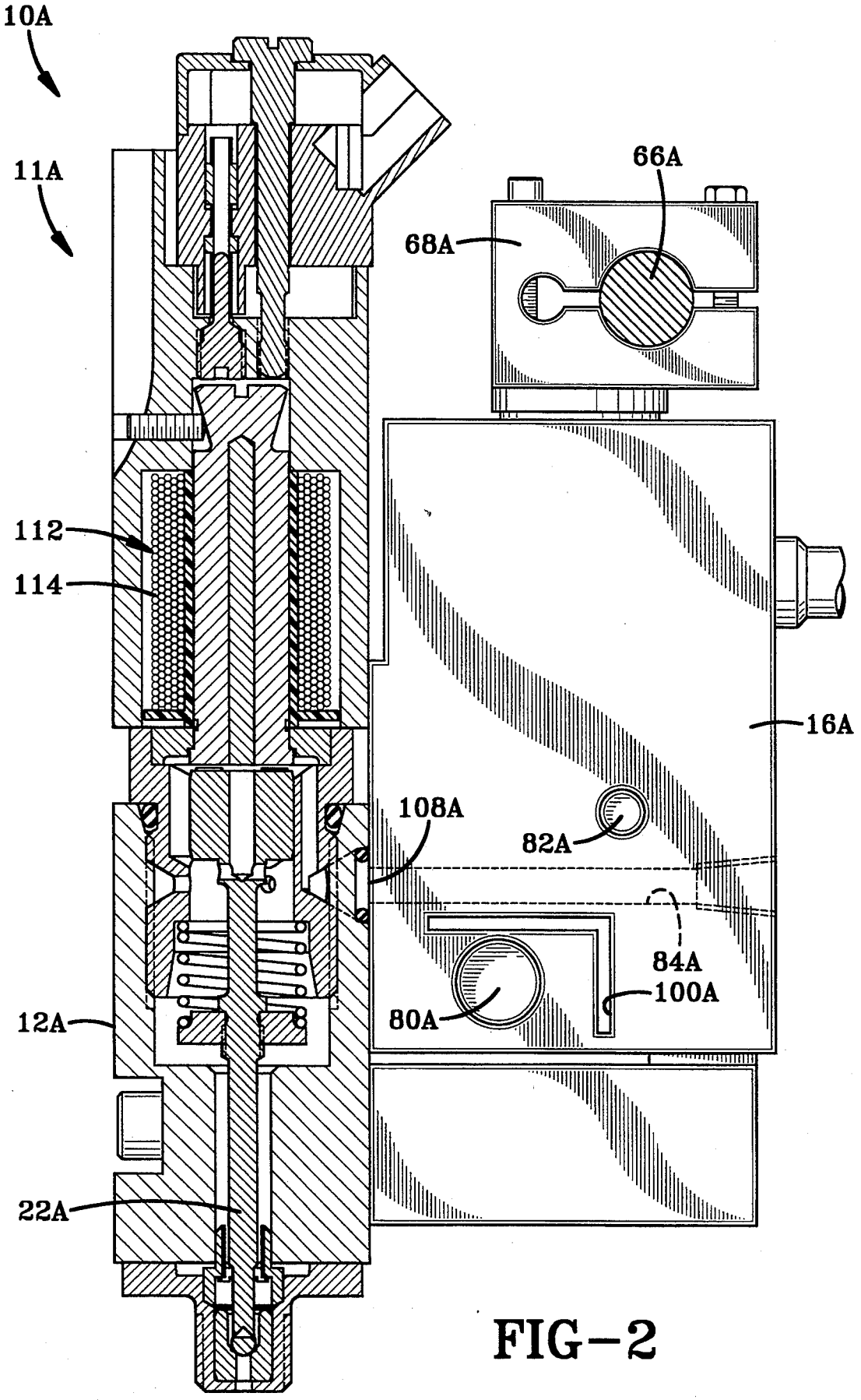
FIG. 2 is a cross-sectional view of a dispenser for dispensing heated fluids in which the plunger is activated by electromagnetic forces and which is used in conjunction with an air gap interposed between the heater and the RTD; and, FIG. 3 is a cross-sectional view of the dispenser shown in FIG. 2 but configured to show a first region and second region of the device.

With reference to FIG. 2, another adhesive dispensing device is shown generally as reference number 10A. In this embodiment, the plunger 22A is activated electromagnetically, as opposed to pneumatically, hydraulically or mechanically. An electromechanical coil assembly 112 includes a coil 114 disposed about a pole piece 116 for generating an electromagnetic field causing the plunger 22A to be attracted to the pole piece 116. The operation of the dispensing module 11A is disclosed more fully in U.S. Pat. No. 5,375,738, which is incorporated herein by reference.

With continuing reference to FIG. 2, the gun body 12A of the dispensing module 11A is made of stainless steel in order to utilize certain electromagnetic aspects of that material as well as to maintain the dimensional integrity of the air gap and the strength required of the gun body. The adhesive manifold 16A is manufactured of aluminum. The difference in thermal condutivity between the stainless steel gun body 12A and the aluminum adhesive manifold 16A makes it difficult to heat both to the proper operating temperature by utilizing heaters 80A,81A only in the manifold 16A. For example, if the dispensing module 11A is heated to the proper temperature, the temperature of the adhesive manifold 16A may be too hot. On the other hand, if the adhesive manifold 16A was kept at the proper temperature, the gun body 12A may become too cold, resulting in ineffective operation of the adhesive dispensing module 11A.

Figure 3:
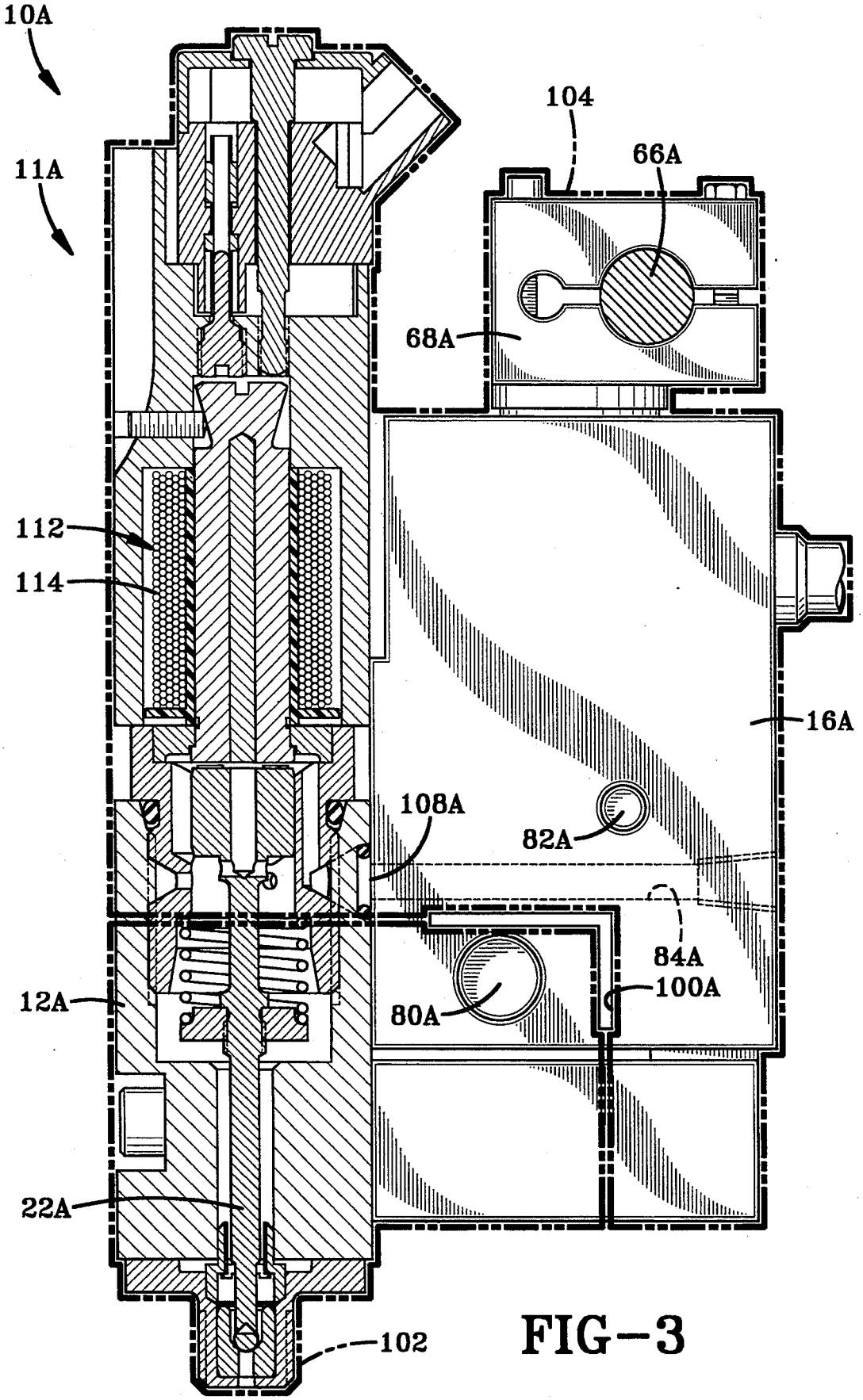

The problem may be solved by the addition of a heat redirecting means in the form of a thermal insulating barrier. With reference to FIGS. 1 and 2, interposed between the heaters 80,80A,81A and the RTDs 82,82A is a heat redirecting means. In the embodiments shown in FIGS. 1 and 2, the redirecting means is an insulating air gap 100,100A configured as an "L-shaped" slot. As illustrated in FIG. 3, the air gap 100A generally divides the adhesive dispensing device 10A into two regions along lines which are roughly extensions of the two line segments making up the "L-shaped" slot. Because heat moves through devices such as the dispensing device 10A in a non-uniform, non-linear manner, the boundaries of the two regions are only approximate.

With continuing reference to FIG. 3, in the lower left portion of the adhesive dispensing device 10A, a first region 102 is created and separated from a second region 104 which is at the upper right portion of the device, the first region 102 being hotter than the second region 104 when configured as shown in FIGS. 2 and 3.

The air gap 100A functions to direct a greater percentage of the heat generated by the heaters 80A,81A toward the first region 102 and less toward the second region 104 than normally would occur without it. In other words, the air gap 100A helps insulate the adhesive inlet line 84A, and RTD 82A from the heat generated by the heaters 80A,81A, thereby directing a larger portion of the heat generated by the heaters 80A, 81A toward the portions of the adhesive dispensing module 11A where it is needed to heat the module as well as the adhesive therein. Similarly, the air gap 100 of FIG. 1, functions to direct a greater percentage of the heat generated by the heater 80 toward the gun body 12 and nozzle 14, than would normally occur without it and away from the adhesive inlet line 84 and RTD 82.

Without the air gaps 100,100A, the RTDs 82,82A would sense that the operating temperatures had been obtained and the heaters 80,80A, and 81A would be de-energized. However, due to the dissimilarity of the material of the manifold 16,16A and the gun body 12,12A, and/or other considerations, the transfer of heat to the dispensing module 11,11A might not be sufficient. If the operating temperature sensed by the RTDs 82,82A on the other hand, is increased to transfer the appropriate amount of heat to the dispensing module 11,11A, too much heat may be transferred to the adhesive inlet line 84,84A, thereby degrading the adhesive, such as by forming solid chunks or particles known commonly as "char." Utilizing the air gap 100,100A, therefore, allows more heat to be directed to the dispensing module 11,11A while avoiding directing too much heat to the adhesive inlet lines 84,84A so as to not degrade the quality of the adhesive.

The "L" shaped configuration of the air gap 100A is especially suited for use with the dispensing module 11A shown in FIG. 2. However, the invention concerns the use of variously shaped redirecting means to fine tune the temperature profile within the adhesive dispensing device 10. The redirecting means might be an insulating air gap of infinitely varied configurations. In addition, the redirecting means could use a thermal insulator other than air. For example, a gap could be filled with a cooling liquid or an insulating material such as fiberglass or asbestos. Air was the preferred thermal insulator in this particular application due to its low cost and availability. Another variant is the use of redirecting means utilizing reflective properties, such as foil, to redirect infrared heat.

As stated above, the configuration of the redirecting means could be adjusted to an infinite number of shapes and sizes depending on each application. As illustrated in FIG. 3, the air gap 100A generally divides the adhesive dispensing device 10A into first and second regions 102,104 on either side of the air gap 100A. While the exact boundaries of the first and second regions 102,104, or even three or four regions, are difficult to determine precisely, they represent a heretofore undiscovered method of directing and controlling the heat generated by heaters 80A,81A within the structure of the adhesive dispensing device 10A or dispensing module 11A.

While certain representative embodiments and details have been shown for the purpose of illustrating the invention, it will be apparent to those skilled in the art that various changes and modifications can be made therein without departing from the scope of the invention.

It is claimed:

1. An apparatus for dispensing hot melt adhesives, said apparatus comprising:

an adhesive manifold, said adhesive manifold having an adhesive passageway therethrough;

heating means for heating said adhesive manifold, said heating means mounted within said adhesive manifold;

temperature sensing means for sensing a temperature of said adhesive manifold, said temperature sensing means mounted within said adhesive manifold; and, redirecting means for redirecting heat to a first region of said apparatus and away from a second region of said apparatus, said redirecting means being mounted within said adhesive manifold between said temperature sensing means and said heating means.

2. The apparatus of claim 1 wherein said redirecting means comprises insulation means between said second region and said heating means.

3. The apparatus of claim 1 wherein said redirecting means is reflective means for reflecting infrared energy.

4. The apparatus of claim 3 wherein said reflective means is foil.

5. The apparatus of claim 1 wherein said redirecting means is an air gap.

6. The apparatus of claim 5 wherein said air gap is an "L-shaped" slot.

7. The apparatus of claim 1 wherein said temperature sensing means is an RTD.

8. The apparatus of claim 1 wherein said apparatus further comprises:

a gun body, said gun body and said dispenser body being made of thermally dissimilar materials.

9. The apparatus of claim 7 wherein said gun body is made of stainless steel and said dispenser body is made of aluminum.

10. The apparatus of claim 1 wherein the apparatus further comprises:

a plunger; and, electromagnetic means for operating said plunger via electromagnetic forces.

11. The apparatus of claim 1 wherein said redirecting means is interposed between said heating means and said adhesive passageway.

12. The apparatus of claim 10 wherein said heat redirecting means is interposed between said heating means and said temperature sensing means.

13. A method of directing heat within an apparatus for dispensing heated material, said apparatus comprising an adhesive passageway, heating means, temperature sensing means, and redirecting means, said method comprising the steps of:

energizing said heating means to heat said apparatus;

directing heat generated by said heating means toward a first region of said apparatus and from a second region of said apparatus by said redirecting means, thereby heating said first region of said apparatus with said heating means to a first desired temperature and heating said second region of said apparatus to a second desired temperature; and, controlling said first and second desired temperatures by controlling energy input to said heating means.

14. The method of claim 13 wherein said redirecting means comprises an air gap.

15. The method of claim 13 wherein said redirecting means is configured and positioned relative to said heating means in order to provide said first and second desired temperatures.

16. The method of claim 13 wherein said redirecting means is interposed between said heating means and said adhesive passageway.

17. The method of claim 13 wherein said apparatus is made of materials having different thermal conducting properties.

18. The method of claim 13 wherein said redirecting means is interposed between said heating means and said temperature sensing means.

19. An apparatus for dispensing hot melt adhesives, said apparatus being made of materials having dissimilar thermal conducting properties, the apparatus comprising:

an adhesive manifold, said adhesive manifold having an adhesive passageway therethrough, said apparatus having a first region and a second region, a part of said second region of said apparatus being made of material of a different thermal conductivity than said first region;

heating means for heating said apparatus, said heating means operatively mounted within said second region of said apparatus;

temperature sensing means for sensing a temperature of said apparatus, said temperature sensing means operatively mounted within said first region of said apparatus; and, redirecting means for directing heat generated by said heating means toward said first region of said apparatus.

* * * * *